US011224794B2

(12) United States Patent
Cerny

(10) Patent No.: US 11,224,794 B2
(45) Date of Patent: Jan. 18, 2022

(54) IN-LINE SKATE BRAKING SYSTEM

(71) Applicant: Stopskate s.r.o., Olomouc (CZ)

(72) Inventor: Jaroslav Cerny, Olomouc (CZ)

(73) Assignee: Stopskate s.r.o., Olomouc (CZ)

( * ) Notice: Subject to any disclaimer, the term of this patent is extended or adjusted under 35 U.S.C. 154(b) by 0 days.

(21) Appl. No.: 16/770,021

(22) PCT Filed: Dec. 7, 2018

(86) PCT No.: PCT/CZ2018/050061
§ 371 (c)(1),
(2) Date: Jun. 4, 2020

(87) PCT Pub. No.: WO2019/110026
PCT Pub. Date: Jun. 13, 2019

(65) Prior Publication Data

US 2021/0205693 A1 Jul. 8, 2021

(30) Foreign Application Priority Data

Dec. 9, 2017 (CZ) ..... CZ2017-790

(51) Int. Cl.
*A63C 17/14* (2006.01)
*A63C 17/06* (2006.01)

(52) U.S. Cl.
CPC ..... *A63C 17/1427* (2013.01); *A63C 17/06* (2013.01); *A63C 2203/12* (2013.01); *A63C 2203/22* (2013.01); *A63C 2203/42* (2013.01)

(58) Field of Classification Search
CPC combination set(s) only.
See application file for complete search history.

(56) References Cited

U.S. PATENT DOCUMENTS 5,388,844 A * 2/1995 Pellegrini, Jr ..... A63C 17/1409 188/29
5,657,999 A * 8/1997 Beaulieu ..... A63C 17/06 280/11.207
5,752,707 A * 5/1998 Cottle ..... A63C 17/1409 188/71.1
5,829,756 A * 11/1998 Mitchell ..... A63C 17/1409 280/11.214
5,868,404 A * 2/1999 Montague ..... A63C 17/1445 280/11.213
6,065,761 A * 5/2000 Gignoux ..... A63C 17/1409 188/29
2003/0214103 A1* 11/2003 Walker ..... A63C 17/26 280/11.203
2006/0181036 A1* 8/2006 Tremblay ..... A63C 17/1409 280/11.212
2007/0132201 A1* 6/2007 Bellehumeur ..... A63C 17/1427 280/87.041
2016/0296828 A1* 10/2016 Ewing, Jr. ..... B60T 11/046

FOREIGN PATENT DOCUMENTS

EP 1168836 A2 * 1/2002 ..... H04N 5/45

* cited by examiner

*Primary Examiner* — Brian L Swenson
(74) *Attorney, Agent, or Firm* — Suzannah K. Sundby, Esq.; Canady + Lortz LLP

(57) ABSTRACT

The subject of the invention is an in-line skate braking system designed to brake in-line skate wheels. This is achieved by an electric motor controlling the action of the brake segment on in-line skate wheels.

22 Claims, 1 Drawing Sheet

IN-LINE SKATE BRAKING SYSTEM

FIELD OF THE INVENTION

Figure 1:
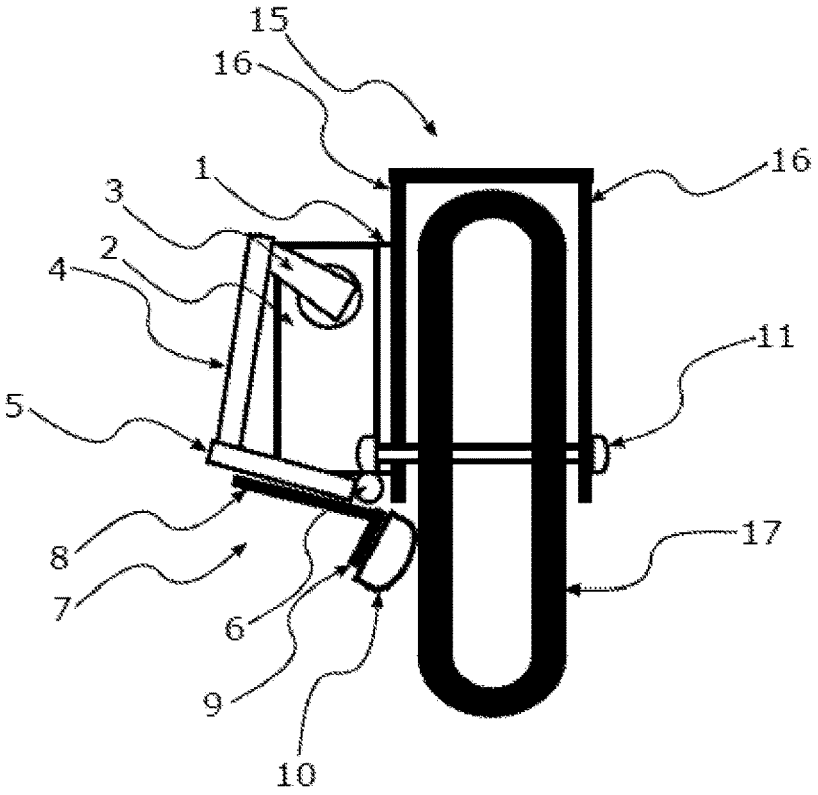

The invention relates to an in-line skate braking system.

BACKGROUND OF THE INVENTION

Currently, for slowing of a ride or stopping in-line skates, a rubber block is used, that is placed at the end of the AI or a PVC wheel holder behind the heel of the skate shoe. This rubber block is usually placed on only one skate. Braking occurs when the front part of the skate is lifted while simultaneously loading the rubber block, thereby friction between the block and ground/road occurs, most often with asphalt or concrete surface of the road. This method of braking is not very efficient and requires a relatively high skill of the skater when controlling in-line skates, wherein collision situations or falling down of skaters often occur while braking.

Other methods of braking require an even higher level of in-line skate control, which a very large part of skaters does not reach and hence does not even use. This is mainly braking using the rear skate, which is turned completely transversely to the direction of travel and forms with the front skate the shape of letter T. Braking in this case occurs when pressure is applied on the wheels of the rear skate, which is turned perpendicularly to the direction of travel, wherein these are rubbing against the ground/road, thereby slowing down the ride until it eventually stops. This style of braking is also not very efficient and the performance thereof in itself is rather demanding. Only very skillful skaters handle it well.

Another option is, for example, going outside the paved path into grass, which in many cases can be very dangerous.

The most common braking techniques outlined above are inefficient, require a high level of in-line skate control, and in many cases are also dangerous, wherein collision situations, accidents and falls resulting in greater or lesser injuries occur very often.

It is often the case that for these reasons many adults and children are afraid to do this sport or feel very uncomfortable while skating.

For the above reasons, it is proposed to design and use special braking systems installed on one or both in-line skates.

One of these systems, as described, for example, in Patent Application No. US2016296828, uses a braking system known from bicycles, wherein rubber blocks are pushed against both sides of the in-line skate inner wheels, using a lever system with one or more fixed rotatable points. A similar braking system is described in Korean Patent Specification KR200333058U, wherein the brake is fastened to the rear side of the skate and therefore only the rear wheel is braked. The above-mentioned braking systems require access to wheels from both sides when mounting and are not suitable for most standardly produced in-line skates. Rear or front wheel braking is inefficient and ineffective due to its smaller diameter due to wear.

Patent Application No. US2003214103 discloses a remote-controlled braking system comprising a remote transmitter, a DC motor controlled by said transmitter over an electrical circuit. The DC motor also controls a hydraulic pump that transmits pressure to a hydraulic piston located from both sides of each wheel, wherein the piston then acts upon linings and these create pressure against the wheels. Patent Application No. US2016375347 discloses another braking system utilizing wireless-controllable hydraulic brakes, e.g. for in-line skates. Similar hydraulic braking systems can be controlled also manually, e.g. by using a hand piston.

In general, braking systems based on an additional inexpensive installation on in-line skates do not always have optimal performance properties during operation, in terms of braking efficiency and reliability.

Higher braking efficiency and reliability are achieved by design solutions requiring intervention in the design solutions of roller skates and a consequent increase in production costs. In most cases, it is not possible to install such braking systems on previously produced in-line skates.

The aim of the present solution is to combine the advantages of both above-mentioned approaches, i.e. easy installation on existing in-line skates while maintaining high braking efficiency and reliability and low costs.

The document EP1166836A1 teaches brake system for a wheeled article, wherein the brake system is integrally mounted in the in-line skate and contains solenoid in the rear side of the boot connected via lever and further elements to the actuation bar placed under the sole and containing cam slots and cam that is connected to the caliper with brake elements.

The document US 2016/0296828 deals with the hand brake mounted to the in-line skate with the similar braking system as for bicycles.

SUMMARY OF THE INVENTION

The above object is achieved by means of an in-line skate braking system containing a brake segment, the essence of which is that the in-line skate braking system further comprises a base plate on which is mounted a battery powered electric motor with a lever of the electric motor, wherein the electric motor (2) is connected to a controller, and a pin with a gripping arm located at the edge of the base plate, wherein the pin is oriented parallel to the plane of the base plate and provides a rotatable connection of the gripping arm to the base plate, a pressure element provided with a brake segment is slidingly attached to the gripping arm, and, spaced apart from the pin, the gripping arm is connected by a hinge to a rod that is connected at the other end by a hinge to the lever of the electric motor. In-line skate braking system meets the above-mentioned goal of cheap additional installation of the braking system by using a base plate and elements mounted thereon. The in-line skate braking system further meets the above-mentioned goal of maintaining high efficiency and reliability through the use of an electric motor-operated brake segment, making it possible to avoid dangerous situations during braking. The use of the electric motor is also advantageous because it is not necessary to use hydraulic system, which causes complications in the spatial solution and the complexity of the whole system.

To provide braking, the braking system according to the invention must be attached to the in-line skate. The base plate is a flat body used for connecting the braking system to the in-line skate, typically to the in-line skate wheel holder. The base plate is connected to the in-line skate so that the pin with the gripping arm is placed on the in-line skate at the lower edge of the base plate and typically parallel to the line joining the centers of the wheels. The base plate is preferably adapted to be attached to the wheel holder, for example it has two through apertures with an elongated, e.g. rectangular, shape, which enable the attachment of such a base plate to the central wheel bolts of different pitches and the possibility of centering the brake segment between the wheels.

The principles of the above-mentioned braking system can also be used when designing new in-line skates. In such case, the base plate carrying the remaining components of the braking system does not necessarily need to be used. Therefore, further object of the invention is also represented by an in-line skate comprising a wheel holder attached to the sole, comprising two parallel walls with wheels mounted rotatably between their inner sides, which are fastened by central wheel bolts, characterized in that on the outer side of at least one wall of the wheel holder is mounted a battery powered electric motor with a lever of the electric motor, wherein said electric motor is connected to a controller, wherein a pin with a gripping arm is further located at the lower edge of the wall of the wheel holder with electric motor, wherein the pin is oriented parallel to the plane of the wall of the wheel holder and provides a rotatable connection of the gripping arm to the wall of the wheel holder, a pressure element provided with a brake segment is slidingly attached to the gripping arm, and, spaced apart from the pin, the gripping arm is connected by a hinge to a rod that is connected at the other end by a hinge to the lever of the electric motor. An in-line skate with the above mentioned components attached to the wall of the wheel holder meets the above-mentioned goal of maintaining high efficiency and reliability through the use of an electric motor-operated brake segment, making it possible to avoid dangerous situations during braking. The use of an electric motor is also advantageous since it is not necessary to use a hydraulic system, which causes complications in the spatial solution and the complexity of the whole system.

The pressure element is provided with brake segment so that when the pressure element is rotated around the pin when braking, the brake segment is pressed against the wheels, or when interrupting the braking, the brake segment is deviated from the wheels. In a preferred embodiment, the pressure element may consist of a first arm of the pressure element and a second arm of the pressure element, which form a single unit, wherein the connection of the pressure element to the gripping arm is realized by means of the first arm of the pressure element connected to the side of the gripping arm, spaced apart from the base plate, and at the same time, the pressure element is oriented so that the place of joining the first arm of the pressure element and the second arm of the pressure element is in the vicinity of the pin, where the brake segment is located on the second arm of the pressure element, from the side opposite the first arm of the pressure element. The first and second arms of the pressure element may preferably form an angle of 70° to 110°. Advantageously, the first arm of the pressure element is connected by means of adjustment bolts to the gripping arm, wherein the adjustment bolts pass through holes made in the gripping arm and the first arm of the pressure element, wherein in at least one of them the hole is approximately rectangular in shape. The use of this connection of the first arm of the pressure element to the gripping arm is preferable because of the possibility of adjusting the distance of the brake segment, located on the second arm of the pressure element, from the wheel by user. The pressure element is typically made of a single piece, which may also have shape different from the one mentioned above, wherein one end thereof is provided with the brake segment. In a preferred embodiment, the brake segment has a round, elliptical or circular shape. This shape helps to create a compressive force throughout the whole lever system and ensures a longer service life during the wearing of the brake segment during the rotational movement thereof.

The electric motor moves the electric motor lever, which then rotates the pressure element by means of the rod and the gripping arm on the pin, thereby pushing the brake segment to the wheels from the side. For the above-mentioned reasons, the use of the electric motor is necessary to maintain high braking efficiency and reliability. The electric motor can be a servomotor or a stepper motor, wherein the use of the servomotor preferably gives the possibility of gradual braking effect.

The electric motor is controlled by the user by means of the connected controller, which will be most commonly held by the user in hand during the ride. The controller may be wired to the electric motor, but preferably can also be connected wirelessly, as it cannot cause dangerous situations arising from the use of a wired electric motor control, such as entanglement of the wire around the user's leg and subsequent fall of the user or rupture of the wire.

The brake segment can be made of different materials. In a preferred embodiment, the brake segment is of rubber or polyurethane. The use of brake segments from these materials is preferred as they have very good adhesive properties, long service life and do not interfere with the structure of the wheel material.

The electric motor requires power for its operation, for which a battery is used. Advantageously, the in-line skate braking system comprises battery located on the base plate, wheel holder, or attached to the in-line skate. The location of the battery on the base plate allows for an inexpensive additional installation of the braking system according to the invention on existing in-line skate models, thereby contributing to the modularity of this solution.

Advantageously, the width of the brake segment is smaller than the distance of the central bolts of the two adjacent wheels and, at the same time, greater than the distance between the edges of the two adjacent wheels at the level of contact of the brake segment with the wheels, wherein the brake segment is centered between two adjacent wheels. The use of the brake segment centered between the two adjacent wheels with the above-mentioned width of the brake segment is preferred because of the possibility of exerting braking force on the pair of wheels, which helps to meet the above-mentioned goals of high braking efficiency and reliability, since braking effect is distributed over larger contact surface; and also of lower wheel wear than would be the case with only one wheel braking.

In a preferred embodiment, the two adjacent wheels, between which the brake segment is centered, are two inner wheels. The braking of the inner wheels is preferable due to their lower wear during skating, compared to the outer wheels, and therefore also due to their larger diameter and thus a better braking effect, which contributes to meeting the above-mentioned goal of high braking efficiency and reliability.

EXEMPLARY EMBODIMENTS OF THE INVENTION

Figure 2:
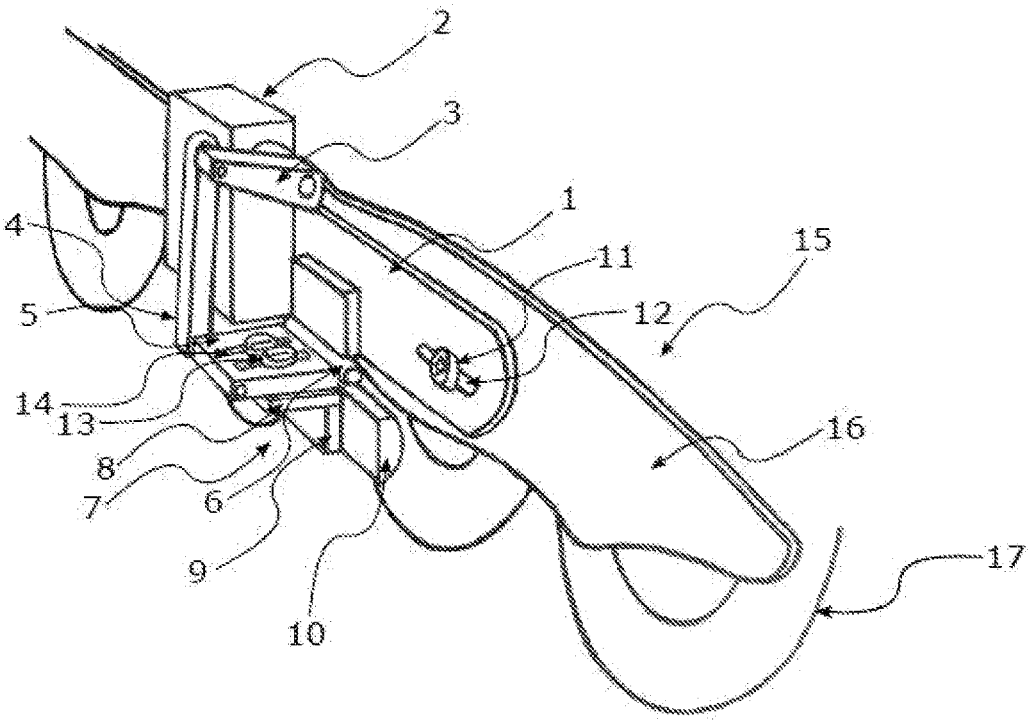

The in-line skate braking system of FIG. 1 and FIG. 2 comprises a base plate 1 on which an electric motor 2 is located. The electric motor 2 is, for example, a servomotor or a stepper motor. The electric motor 2 can be controlled by a wired controller or, preferably, by means of a wireless controller. The movement of the electric motor 2 axis is transmitted via the lever 3 of the electric motor 2 by means of a hinge to the rod 4 and at the other end of the rod 4 by a hinge to the gripping arm 5 which is attached to the pin 6 located at the edge of the base plate 1. The pin 6 provides for the rotatable connection of the gripping arm 5 with the base plate 1 and is oriented parallel to the plane of the base plate 1. The gripping arm 5 and pin 6 can be in the form of a hinge. The coupling of the rod 4 with the gripping arm 5 is spaced apart from the pin 6. A pressure element 7 is attached to the gripping arm 5 on the side spaced apart from the base plate 1.

In an alternative embodiment, a wheel 17 holder 15 comprising two parallel walls 16 is attached to the in-line skate sole, wherein an electric motor 2 is located on the outside of at least one wall 16. The wheels 17 are rotatably mounted between the walls 16 of the wheel 17 holder 15. The electric motor 2 is, for example, a servomotor or a stepper motor. The electric motor 2 can be connected to the controller in a wired or, preferably, wireless manner. The movement of the electric motor 2 axis is transmitted via the lever 3 of the electric motor 2 by means of a hinge to the rod 4 and at the opposite end of the rod by a hinge to the gripping arm 5, attached to the pin 6 located at the lower edge of the wall 16 of the wheel 17 holder 15 with electric motor 2. The pin 6 is oriented parallel to the plane of the wall 16 of the wheel 17 holder 15 and provides for the rotatable connection of the gripping arm 5 with the wall 16 of the wheel 17 holder 15. The gripping arm 5 and pin 6 can be in the form of a hinge. The coupling of the rod 4 with the gripping arm 5 is spaced apart from the pin 6. A pressure element 7 is attached to the gripping arm 5 on the side spaced apart from the wall 16 of the wheel 17 holder 15 with electric motor 2.

In this embodiment, the pressure element 7 consists of a first arm 8 of the pressure element 7 and a second arm 9 of the pressure element 7, these arms of the pressure element 7 forming one unit and forming an angle, e.g., from 70° to 110°. The pressure element 7 is attached to the gripping arm 5 by means of the first arm 8 of the pressure element 7 oriented so, that the second arm 9 of the pressure element 7 is close to the pin 6. This connection may preferably be slidable, for example by means of the holes 14 disposed in the gripping arm 5 and in the first arm 8 of the pressure element 7, through which the adjustment bolts 13 pass, wherein at least one hole 14 is approximately rectangular in shape, and the adjustment bolts 13 ensure that the first arm 8 of the pressure element 7 is locked in a certain position of the holes 14. On the opposite side of the first arm 8, a brake segment 10 made of an adhesive material is located on the second arm 9 of the pressure element 7.

The brake segment 10 may be, e.g., of rubber or polyurethane. In a preferred embodiment, the width of the brake segment 10 is smaller than the distance of the central bolts 11 of adjacent wheels 17 and, at the same time greater than the distance between the edges of the two adjacent wheels 17 at the level of contact of the brake segment 10 with the wheels 17.

A battery for powering the electric motor 2 is further attached to the base plate 1. In an alternative embodiment, the battery can be mounted on the wheel 17 holder 15, attached to the in-line skate shoe or integrated in the in-line skate shoe.

The base plate 1 is a planar structure of various shapes suitable for the positioning of the described elements, and can be centerably connectable to the central bolts 11 of wheels 17, e.g., by means of two through apertures 12 with an elongated, e.g., rectangular shape, disposed in the base plate 1. The base plate 1 can be connectable to one or more central bolts 11 of wheels 17. The central bolts 11 of wheels 17 can be replaced by bolts suitable for fastening the base plate 1, e.g., by bolts with a square countersunk head. In a preferred embodiment, the base plate 1 is centered so that the brake segment 10 is centered between two inner wheels 17. In case of a four-wheel in-line skate, the inner wheels 17 are the second wheel 17 and the third wheel 17, or in case of a five-wheel in-line skate, the second wheel 17 and the third wheel 17 or the third wheel 17 and the fourth wheel 17. In a preferred embodiment, on the side of the base plate 1 on which individual components of the braking system are disposed, a cover protecting the individual components of the braking system may be provided.

In an alternative embodiment, when the electric motor 2, the pin 6 with the gripping arm 5, the pressure element 7 and the brake segment 10 are located on the wall 16 of the wheel 17 holder 15, the brake segment 10 is preferably centered between two inner wheels 17.

In a preferred embodiment, an electronic module can be provided on the base plate 1 or in an alternative embodiment on the wall 16 of the wheel 17 holder 15, which may also include a signal receiver or a battery charging connector, e.g., USB. In an alternative embodiment, the electronic module may be attached to the wheel holder, shoe, or integrated into the in-line skate shoe.

In one embodiment, only one in-line skate is braked and thus only one braking system is used, which is attached to the right or left in-line skate on the outside of at least one wall 16 of the wheel 17 holder 15. In a preferred embodiment, both in-line skates are braked and thus two braking systems are used, one on each in-line skate.

In a preferred embodiment, the braking system always uses the braking of a pair of wheels 17 on one skate, that is, four wheels 17 are braked in a pair of in-line skates. In case of four-wheel in-line skates, the braking is then braking only of two in-line skate inner wheels 17. In a preferred embodiment, both in-line skates are braked synchronously at the same time, or with a gradual advance of the braking effect of one of the in-line skates.

In a preferred embodiment, both skates are braked synchronously at the same time or with a gradual advance of the braking effect of one of the in-line skates. Thus, the braking force is then transferred to both skates, i.e. four wheels 17.

Adhesion between the brake segment 10 and wheels 17 is used to brake the wheels 17. The brake segment 10 can be of a shape adapted for the greatest possible contact area with the wheels 17. To ensure the most effective braking effect and at the same time the extended service life of the segment, it is important to place the brake segment 10 close to the axis of rotation, wherein the shape of the brake segment 10 is curved, elliptical or circular.

A preferred embodiment of the wireless connection of the controller with the electric motor can be realized, e.g., by means of radio waves (RC), Wi-Fi, Bluetooth, or another suitable wireless interface.

LIST OF REFERENCE NUMBERS

1—Base plate
2—Electric motor
3—Lever of the electric motor
4—Rod
5—Gripping arm
6—Pin
7—Pressure element
8—First arm
9—Second arm
10—Brake segment
11—Central bolt

12—Through aperture
13—Adjustment bolts
14—Hole
15—Wheel holder
16—Wheel holder wall
17—Wheel

The invention claimed is:

1. An in-line skate braking system containing a brake segment (10), wherein the in-line skate braking system further comprises a base plate (1) on which is mounted a battery powered electric motor (2) with a lever (3) of the electric motor (2), wherein the electric motor (2) is connected to a controller, and a pin (6) with a gripping arm (5) located at the edge of the base plate (1), wherein the pin (6) is oriented parallel to the plane of the base plate (1) and provides a rotatable connection of the gripping arm (5) to the base plate (1), a pressure element (7) provided with a brake segment (10) is slidingly attached to the gripping arm (5), and, spaced apart from the pin (6), the gripping arm (5) is connected by a hinge to a rod (4) that is connected at the other end by a hinge to the lever (3) of the electric motor (2), wherein the plane of the base plate (1) is oriented vertically.

2. An in-line skate comprising a wheel holder (15) attached to the sole, comprising two parallel walls (16) with wheels (17) mounted rotatably between their inner sides, which are fastened by central wheel bolts (11), and comprising an in-line skate braking system according to claim 1, wherein the base plate (1) has two through apertures (12) with an elongated shape formed therein.

3. The in-line skate according to claim 2, wherein the in-line skate braking system further comprises a battery located on the wheel holder (15), or attached to the in-line skate.

4. The in-line skate according to claim 2, wherein the width of the brake segment (10) is smaller than the distance of the central bolts (11) of two adjacent wheels (17) and, at the same time, greater than the distance between the edges of two adjacent wheels (17) at the level of contact of the brake segment (10) with the wheels (17), wherein the brake segment (10) is centered between two adjacent wheels (17).

5. The in-line skate according to claim 4, wherein the two adjacent wheels (17) between which the brake segment (10) is centered, are two inner wheels (17).

6. The in-line skate according to claim 2, wherein the pressure element (7) consists of a first arm (8) of the pressure element (7) and a second arm (9) of the pressure element (7), which form a single unit, wherein the connection of the pressure element (7) to the gripping arm (5) is realized by means of the first arm (8) of the pressure element (7) connected to the side of the gripping arm (5) spaced apart from the base plate (1), and at the same time, the pressure element (7) is oriented so that the place of joining the first arm (8) of the pressure element (7) and the second arm (9) of the pressure element (7) is in the vicinity of the pin (6), a brake segment (10) is located on the second arm (9) of the pressure element (7), from the side opposite the first arm (8) of the pressure element (7).

7. The in-line skate according to claim 6 wherein the first and second arms of the pressure element (7) form an angle of 70° to 110°.

8. The in-line skate according to claim 6 wherein the first arm (8) of the pressure element (7) is connected by means of adjustment bolts (13) to the gripping arm (5), wherein the adjustment bolts (13) pass through holes (14) made in the gripping arm (5) and in the first arm (8) of the pressure element (7), wherein in at least one of them the hole (14) is approximately rectangular in shape.

9. The in-line skate according to claim 2, wherein the electric motor (2) is a servomotor or a stepper motor.

10. The in-line skate according to claim 2, wherein the electric motor (2) is controllable by a controller in a wireless manner.

11. The in-line skate according to claim 2, wherein the brake segment (10) is of rubber, polyurethane, or other adhesive material.

12. The in-line skate according to claim 2, wherein the in-line skate braking system further comprises a battery located on the base plate (1).

13. The in-line skate according to claim 2, wherein the elongated shape is a rectangular shape.

14. The in-line skate braking system according to claim 1, wherein the pressure element (7) consists of a first arm (8) of the pressure element (7) and a second arm (9) of the pressure element (7), which form a single unit, wherein the connection of the pressure element (7) to the gripping arm (5) is realized by means of the first arm (8) of the pressure element (7) connected to the side of the gripping arm (5) spaced apart from the base plate (1), and at the same time, the pressure element (7) is oriented so that the place of joining the first arm (8) of the pressure element (7) and the second arm (9) of the pressure element (7) is in the vicinity of the pin (6), a brake segment (10) is located on the second arm (9) of the pressure element (7), from the side opposite the first arm (8) of the pressure element (7).

15. The in-line skate braking system according to claim 14 wherein the first and second arms of the pressure element (7) form an angle of 70° to 110°.

16. The in-line skate braking system according to claim 14 wherein the first arm (8) of the pressure element (7) is connected by means of adjustment bolts (13) to the gripping arm (5), wherein the adjustment bolts (13) pass through holes (14) made in the gripping arm (5) and in the first arm (8) of the pressure element (7), wherein in at least one of them the hole (14) is approximately rectangular in shape.

17. The in-line skate braking system according to claim 1, wherein the electric motor (2) is a servomotor or a stepper motor.

18. The in-line skate braking system according to claim 1, wherein the electric motor (2) is controllable by a controller in a wireless manner.

19. The in-line skate braking system according to claim 1, wherein the brake segment (10) is of rubber, polyurethane, or other adhesive material.

20. The in-line skate braking system according to claim 1, further comprising a battery located on the base plate (1).

21. The in-line skate braking system according to claim 1, wherein the base plate (1) is mountable on one of two parallel walls (16) of a wheel holder (15).

22. An in-line skate comprising a battery powered electric motor (2) connected to a lever (3) which is further connected by a hinge to a rod (4), and further comprising a wheel holder (15) attached to the sole, comprising two parallel walls (16) with wheels (17) mounted rotatably between their inner sides, which are fastened by central wheel bolts (11), wherein a pin (6) with a gripping arm (5) is further located at the lower edge of the wall (16) of the wheel holder (15), wherein the pin (6) is oriented parallel to the plane of the wall (16) of the wheel holder (15) and provides a rotatable connection of the gripping arm (5) to the wall (16) of the wheel holder (15), wherein a pressure element (7) provided with a brake segment (10) is attached to the gripping arm (5), wherein said battery powered electric motor (2) is mounted on the outer side of at least one wall (16) of the wheel holder (15) and it is connected to a controller and said rod (4) spaced apart from the pin (6) is connected by a hinge to said gripping arm (5).

* * * * *